US009106011B2

(12) United States Patent
Bengtsson et al.

(10) Patent No.: US 9,106,011 B2
(45) Date of Patent: Aug. 11, 2015

(54) ELECTRICAL CONNECTION ARRANGEMENT HAVING A FASTENER ABUTTING AN UNCOATED PORTION OF A SLEEVE

(75) Inventors: Kjell-Ewe Bengtsson, Eskilstuna (SE); Otto Johansson, Hallsberg (SE)

(73) Assignee: Volvo Construction Equipment AB, Eskilstuna (SE)

( * ) Notice: Subject to any disclaimer, the term of this patent is extended or adjusted under 35 U.S.C. 154(b) by 40 days.

(21) Appl. No.: 13/978,716

(22) PCT Filed: Feb. 3, 2011

(86) PCT No.: PCT/SE2011/000019

§ 371 (c)(1),
(2), (4) Date: Jul. 9, 2013

(87) PCT Pub. No.: WO2012/105875

PCT Pub. Date: Aug. 9, 2012

(65) Prior Publication Data

US 2013/0303013 A1 Nov. 14, 2013

(51) Int. Cl.
*H01R 13/625* (2006.01)
*H01R 13/62* (2006.01)
(Continued)

(52) U.S. Cl.
CPC ..... *H01R 13/62* (2013.01); *H01R 4/30* (2013.01); *H01R 4/64* (2013.01); *H01R 4/70* (2013.01);
(Continued)

(58) Field of Classification Search
CPC .... H01R 13/62; H01R 13/621; H01R 13/639; H01R 13/6395
USPC ..... 439/886–887, 345
See application file for complete search history.

(56) References Cited

U.S. PATENT DOCUMENTS 4,573,757 A * 3/1986 Cochran et al. ..... 439/271
4,873,763 A 10/1989 Volonta et al.
(Continued)

FOREIGN PATENT DOCUMENTS

CH 666144 A 6/1988
DE 19960736 C1 7/2001
(Continued)

OTHER PUBLICATIONS

Supplementary European Search Report (Jun. 17, 2014) for corresponding European App. EP 11 85 7749.
(Continued)

*Primary Examiner* — Chandrika Prasad
(74) *Attorney, Agent, or Firm* — WRB-IP LLP

(57) ABSTRACT

A method for providing an electrical connection arrangement between a first member and a second member is provided, as is a corresponding arrangement. The first member is made of electrically conductive material provided with a coating layer, and the electrical connecting arrangement includes a fastening element, the method including providing the first member with a first hole, arranging a sleeve in the first hole of the first member, such that the first member becomes electrically connected with the sleeve, coating an area of the first member including the sleeve, inserting the fastening element into the sleeve and through the first member, and engaging the fastening element with the second member, such that the fastening element becomes abutted against an uncoated surface portion provided on the sleeve to electrically connect the sleeve with the fastening element, and such that the fastening element becomes electrically connected to the second member.

8 Claims, 6 Drawing Sheets

(51) Int. Cl.

| | |
|---|---|
| ***H01R 4/30*** | (2006.01) |
| ***H01R 4/64*** | (2006.01) |
| ***H01R 43/26*** | (2006.01) |
| ***H01R 43/20*** | (2006.01) |
| ***H01R 4/70*** | (2006.01) |
| ***H01R 13/621*** | (2006.01) |

(52) U.S. Cl.
CPC ..... *H01R 13/621* (2013.01); *H01R 43/205* (2013.01); *H01R 43/26* (2013.01); *Y10T 29/49208* (2015.01)

(56) References Cited

U.S. PATENT DOCUMENTS

| | | | | |
|---|---|---|---|---|
| 5,207,588 | A * | 5/1993 | Ladouceur et al. | 439/84 |
| 5,453,027 | A * | 9/1995 | Buell et al. | 439/433 |
| 5,461,534 | A | 10/1995 | Gondot et al. | |
| 5,828,008 | A | 10/1998 | Lockwood et al. | |
| 8,627,617 | B2 * | 1/2014 | Haddock et al. | 52/173.3 |
| 2011/0142567 | A1 * | 6/2011 | Haylock et al. | 411/360 |

FOREIGN PATENT DOCUMENTS

| | | | |
|---|---|---|---|
| EP | 1469559 | A2 | 10/2004 |
| JP | H07202371 | A | 8/1995 |
| WO | 2005025005 | A1 | 3/2005 |

OTHER PUBLICATIONS

International Search Report (Sep. 30, 2011) for corresponding International application No. PCT/SE2011/000019.

International Preliminary Report on PatentabilityJun. 4, 2013) for corresponding International appiication No. PCT/SE2011/000019.

* cited by examiner

ELECTRICAL CONNECTION ARRANGEMENT HAVING A FASTENER ABUTTING AN UNCOATED PORTION OF A SLEEVE

BACKGROUND AND SUMMARY

The present invention relates, according to an aspect thereof, to a method for providing an electrical connection arrangement between a first member and a second member, wherein said first member being made of electrically conductive material provided with a coating layer, and wherein said electrical connecting arrangement comprising a fastening element for connecting said first and second members. The present invention also relates, according to an aspect thereof, to an electrical connection arrangement comprising a first member, a second member, and a fastening element, wherein said first member being made of electrically conductive material provided with a coating layer.

Electronic equipment, such as electronic control units arranged on different members in for example a vehicle require good earth connections between the different members for proper and reliable functioning, partly due to the diminishing signal levels used in modern electronic equipment. High quality earth connections provide low electrical resistance between the different members, thus assuring substantially the same electrical reference potential over the entire electrical system. This is particularly demanding in vehicle applications where no physical ground connection is available. Instead, the bodywork or chassis of the vehicle serves as zero potential voltage reference and as return path for the entire electrical system of the vehicle.

Prior art solutions for providing earth connection between for example an electronic product mounted and connected to an separate electrically conducting support structure and chassis main ground rely mainly on studs welded to the separate members, which studs were covered during painting not to become coated for maintained electrical contact. Subsequent interconnection of the support structure and chassis ground is often made by braided earth leads secured to the welded studs. This solution has the disadvantage of high manufacturing costs, poor corrosion resistance and low flexibility with respect to mounting of addition equipment after sales due to lack of studs.

Another prior art disclosed in WO 2005/025005 shows a ground connection based on a separate grounding element that is secured to a hole in the chassis main ground, wherein the grounding element is adapted to receive a ground cable for earth connection with a support structure. This solution however has the disadvantage of not providing a reliable earth connection, and suffering from risk of corrosion.

There is thus a need for an improved electrical connection between different members removing the above-mentioned disadvantages.

It is desirable to provide an inventive method for providing an electrical connection arrangement between a first member and a second member where the previously mentioned problems are partly avoided. According to an aspect of the invention, a first member is made of electrically conductive material provided with a coating layer, and wherein said electrical connecting arrangement comprising a fastening element. The method further comprises the steps of providing said first member with a first hole, arranging a sleeve in said first hole of said first member, such that said first member becomes electrically connected with said sleeve, coating an area of said first member comprising said sleeve, and inserting said fastening element into said sleeve and through the first member, and engaging said fastening element with said second member, such that the fastening element becomes abutted against an uncoated surface portion provided on said sleeve to electrically connect said sleeve with said fastening element, and such that said fastening element becomes electrically connected to said second member.

According to another aspect of the invention, an electrical connection arrangement comprising a first member, a second member, and a fastening element is provided, wherein said first member being made of electrically conductive material provided with a coating layer and a first hole, wherein a sleeve is arranged in said first hole prior to application of said coating layer, such that said first member is electrically connected to said sleeve, said fastening element is arranged to abut an uncoated surface portion of said sleeve to provide electrical contact between said sleeve and said fastening element, and said fastening element is engaged with said second member, such that said fastening element is electrically connected to said second member.

Aspects of the invention provide a cost-efficient and flexible solution for providing one or several earth connections between a first member in form of for example a bolted-on support structure and a second member in form of for example a chassis main ground. Attachment of the sleeve can be made in a fast and simple manner and suitable for automated manufacturing, and after complete installation, good corrosion resistant is provided by means of the coating layer of the first member in combination with a corrosion-averse material of the sleeve. The uncoated surface portion of the sleeve is arranged to be in electrical contact with the fastening element, and eliminates thus any need of for example a toothed washer applied for penetrating a coating layer of the sleeve.

The contact surface between the sleeve and first member is also significantly increased by means of the flange of the sleeve, which flange is arranged to abut the surface of the first member, thus minimizing electrical resistance between the first member and the sleeve. Electrical connection between the sleeve and the second member is subsequently fast and efficiently accomplished by means of the fastening element that is arranged to abut the sleeve and to engage the second member, and to electrically interconnect these parts.

Finally, the electrical connection arrangement apart from providing an earth connection also provides a rigid and reliable mechanical connection between the first and second members, thus largely removing the need for other assembly means for this purpose.

The method for providing an electrical connection arrangement advantageously further comprises the step of realising the electrical connection between said fastening element and said second member by means of threads of the fastening element, or by means of welding, soldering or riveting the fastening element to said second member. A threaded connection is a cost-effective and flexible method of attachment that also reliably abuts the fastening element against the sleeve in a simple manner.

The method for providing an electrical connection arrangement advantageously further comprises the step of providing said second member with a second hole, and coating an area of said second member comprising said second hole. This provides simplified attachment of the fastening element, such as the use of a self-tapping threaded fastening element, or forming of threads during a separate method step.

The method for providing an electrical connection arrangement advantageously further comprises the step of providing the fastening element with a head and a threaded shank, and realising the electrical connection between said threaded shank and said second member by providing said threaded shank with threads that are configured to penetrate the coating layer within said second hole, and to form threads within said second hole of said second member. This subject-matter thus provides a fast, reliable, corrosion resistant and efficient way of assembling the electrical connection arrangement.

The method for providing an electrical connection arrangement advantageously further comprises the step of providing the fastening element with a head and a threaded shank, and realising the electrical connection between said threaded shank and said second member by forming threads within said second hole of said second member, covering said threads of said second hole prior to coating of said second member with a first cover, and subsequently removing said first cover to provide a coated second member having a second hole provided with uncoated threads. This method represents an alternative method for realising threads in said second hole of the second member that may be preferred depending on material parameters, coating parameters, manufacturing, and the like.

The step of arranging said sleeve in said first hole of said first member method advantageously comprises arranging a flange of said sleeve on a rear side of said first member facing said second member. Preferably, the flange abuts said rear side and is secured thereto by means of welding. The flange may be arranged to function as distance member between the first and second members in joined configuration, and the length of the sleeve of the sleeve may preferably be selected such that an end surface of the sleeve protrudes a certain distance beyond the front surface of the first member, such that the fastening element abuts said end surface during engagement of said fastening element. Furthermore, by providing the flange on the rear surface, there is no risk that weld spatter will negatively affect the electrical connection quality between the fastening element and the sleeve, which could be the case if the fastening element would abut the flange.

The step of arranging said sleeve in said first hole of said first member method advantageously comprises arranging the flange of said sleeve on a front side of said first member facing away from said second member. One advantage of this configuration is that the length of the sleeve may be easily adapted, and that the part of sleeve that is protruding on the rear side of the first member may be arranged to function as a distance member having a large freedom of selectable parameters. The electrical contact surface between the fastening element and the sleeve is also increased, assuring a good electrical connection there between.

The method for providing an electrical connection arrangement advantageously further comprises the step of providing adhesive material between said first and second members. The adhesive material improves joining of said first and second members, and efficiently seals the contact area and reduces risk of corrosion.

Advantageously, said sleeve is arranged to protrude a certain distance beyond a rear surface of the first member facing the second member, and to form a spacing element between said first and second members. Hereby, the first and second members may be safely mounted with a distance in-between, and over-compression of any adhesive material arranged between the members may be prevented. Either the flange part or the sleeve part of the sleeve will protrude depending on how the sleeve is arranged within the first hole.

The method step of providing an uncoated surface portion on said sleeve advantageously involves covering said surface portion with a second cover prior to coating said first member, and subsequently removing said second cover after coating to provide a coated first member having said uncoated surface portion. Hereby, a high quality abutment surface is provided on the sleeve, substantially without coating traces.

The method for providing an electrical connection arrangement advantageously further comprises the step of selecting the size of said second cover such that said uncoated surface portion is limited to said sleeve. In case the flange of the sleeve abuts a front surface of said first member, the size of said second cover is selected such that said coating layer covers a rim and a potential weld area of said flange, and extends a certain distance towards the centre of said flange. In case the flange of the sleeve abuts a rear surface of said first member, the size of said second cover is selected such that said coating layer extends onto the protruding sleeve of the sleeve. In either case, the coating layer is arranged to extend onto the sleeve and thus to completely seal the first member, such that the likeliness of moisture reaching uncoated areas of the first member is reduced. In case the sleeve is welded to the front surface of the first member, the coating may advantageously cover also the weld area of the sleeve, thus reducing the likelihood of corrosion thereof.

First and/or second cover may advantageously be formed of a plastic plug that is inserted into the sleeve during coating thereof. Preferably, said plug is made of silicone to assure good cover performance.

The method for providing an electrical connection arrangement comprising the step of providing an uncoated surface portion on said sleeve advantageously involves mechanically, thermally or chemically removing the coating layer on said sleeve corresponding to said surface portion after coating to provide a coated first member having said uncoated surface portion. This process step provides a fast and efficient solution for providing said uncoated surface portion, whereby no cover needs to be handled during the coating process, which cover may otherwise fall of. Moreover, the size, shape and location of the uncoated surface portion may be easily adapted at the end of the manufacturing process.

The method for providing an electrical connection arrangement advantageously further comprises the step of securing said sleeve in said first hole of said first member by welding, riveting or press-fitting said sleeve with said first member. Most important is that the fastening solution provides good electrical contact between the sleeve and first member. The electrical contact may be further improved by providing the sleeve of the sleeve with exterior ribs or projections that engage the inner surface of the first hole in the first member.

Advantageously, said sleeve and/or said fastening element are made of a corrosion resistant material, in particular stainless steel, or are provided with a corrosion resistant coating. Some areas of the sleeve and fastening element will remain uncoated after complete assembly, and may therefore be exposed to a corrosive environment. Corrosion resistance is therefore of benefit.

Advantageously, said coating layer is powder coating that preferably is applied in a painting process.

Advantageously, electronic equipment, such as micro computers and relays, is attached, and provided with a ground connection to said first member, and said second member forms part of a electrically conducting frame structure of a device, in particular a vehicle, wherein said electrical connection arrangement serves to provide said electronic equipment with at least one earth connection to said frame structure, preferably two separate earth connections to said frame structure, and more preferably at least three separate earth connections to said frame structure. Each of the inventive earth connections is provided without the use of earth cables and provides thus a reliable ground connection with low electrical resistance, thus satisfying the current demands earth connections of low signal voltage electrical control units.

BRIEF DESCRIPTION OF THE DRAWINGS

The present invention will now be described in detail with reference to the figures, wherein.

DETAILED DESCRIPTION

Figure 1:
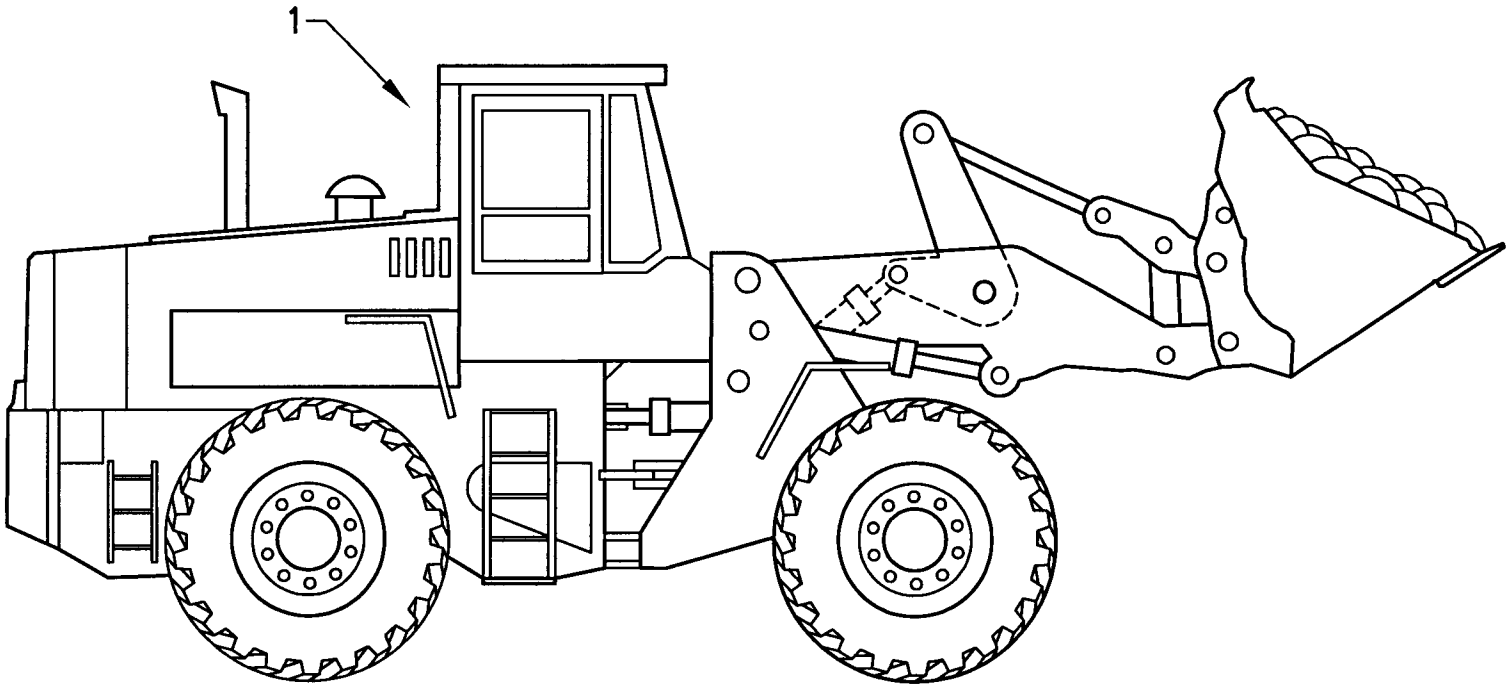
FIG. 1 shows a working machine as an example of object of implementation of the invention.

FIG. 1 shows a working machine comprising an electrical system having a plurality of modules for operation and control thereof. The electrical system comprises therefore electronic equipment, such as electronic control units, fuses and circuit-breakers. Many of these units are dependent on common electrical grounding system for proper functioning, but they may be arranged in different locations on the vehicle. The common electrical grounding system can then utilise the main chassis as mutual ground plane. In the present embodiment, the electrical equipment is arranged on an inner side of a first member 1 in form of a rear wall of the driver's cabin.

Figure 2:
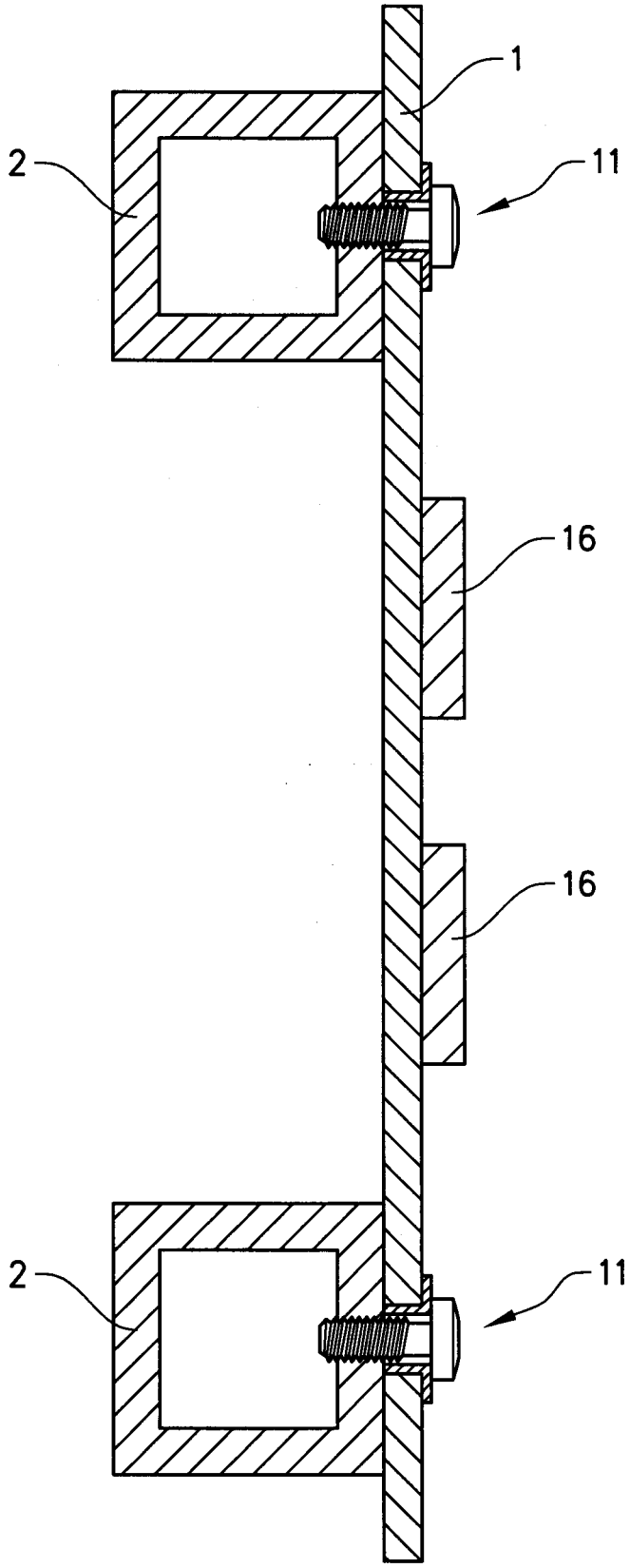
FIG. 2 shows a more detailed implementation of the electrical connection arrangement according to the invention.

FIG. 2 shows a cross-section of the rear wall of the driver's cabin, wherein the first member 1 is secured to a second member 2, in form of electrically conducting frame structure that forms part of the vehicle common ground plane. Fasted to the first member 1 are modules of electronic equipment 16, such as micro computers, fuses and relays, wherein the ground planes of individual electronic equipment 16 are electrically connected to the first member 1, which is made of electrically conductive material provided with a coating layer. The first member 1 subsequently forms part of the chassis common ground via the electrical connecting arrangements 11 according to the invention. The inventive electrical connection arrangements 11 thus serve to provide the electronic equipment 16 with at least one earth connection to the second member 2.

The number of separate electrical connection arrangements 11 used for connecting the first member 1 to the second member 2, and their individual location, is selected depending mainly on the size of the first member 1. A relatively large and extending first member 1 requires increased number of distributed electrical connection arrangements 11 for providing as low potential difference as possible at different locations of the first member 1. Preferably, at least two separate and evenly distributed electrical connection arrangements 11 are provided on the first member 1, and more preferably at least four separate and evenly distributed electrical connection arrangements 11. The ground connection between the electronic equipment 16 and the first member 1 may be implemented by means of self-tapping screws, riveting, or earth cables, or the like.

The attachment of the rear wall, also labelled first member 1, to the frame structure, also labelled second member 2, should both support the rear wall, as well as providing an excellent, low-resistant electrical connection arrangement 11 between the rear wall and frame structure.

Figure 3:
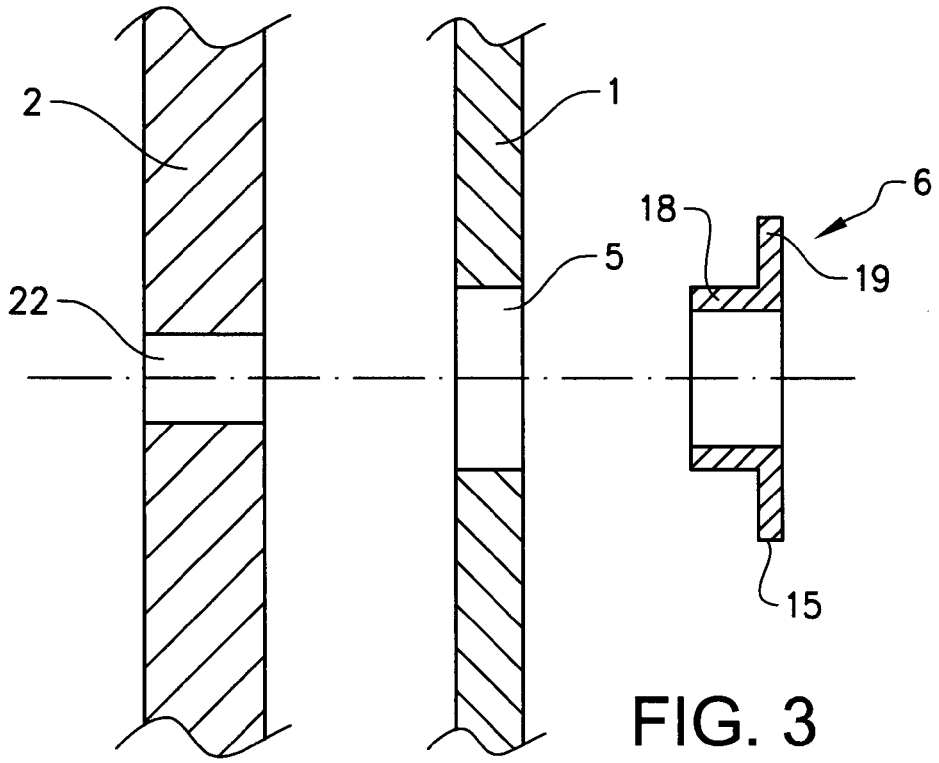
FIG. 3 shows the inventive arrangement prior to assembly.

A method for providing an electrical connection arrangement 11 between a first member 1 and a second member 2 according to a first embodiment of the invention is illustrated in FIG. 3 to 7. In FIG. 3, a first member 1 made of electrically conductive material is provided with a first hole 5, and a second member 2 also made of electrically conductive material and forming part a common ground plane is provided with a second hole 22. An electrically conductive sleeve 6 is also illustrated before attachment thereof in said first hole 5. The sleeve 6 can be a pure sleeve or a flange sleeve. The term flange sleeve is considered to define a member having a sleeve-shaped body including a radial projection, preferably at one end region thereof, and serving as abutment surface when the sleeve-shaped body is inserted in a hole. Although the invention is not limited to the use of a flange sleeve, the term flange sleeve is used hereinafter in the following embodiment examples. The flange sleeve 6 can formed from a single piece of metal, or being assembled into a single piece by joining a separate disc part and a separate sleeve part. The flange 19 of the flange sleeve 6 preferably exhibits a circular continuous circumferential rim 15, but may alternatively exhibit cut-outs, slits, or windows in the flange, for example resulting in a non-circular circumferential rim 15. Likewise, the sleeve 18 of the sleeve flange 6 preferably exhibits a continuous cylindrical shape, but may alternatively exhibit cut-outs, slits, or windows, such as for example elastic tongues are formed, which tongues may aid in fastening of the flange sleeve 6 in the first hole 5. One of the functions of the flange sleeve 6 is to electrically interconnect the first member 1 with the fastening element 4 that is arranged to be introduced in a central aperture in the flange sleeve 6, and to abut against the flange 19. Moreover, the flange sleeve is also arranged to provide the electrical connection arrangement 11 with a certain level corrosion protection.

The flange sleeve 6 may exhibit uncoated areas in the finished electrical connection arrangement 11 and should therefore advantageously be provided with some type of corrosion protection. The flange sleeve 6 may thus comprise a corrosion resistant coating, or it may be made of a corrosion resistant material, such as stainless steel, or aluminum.

Figure 4:
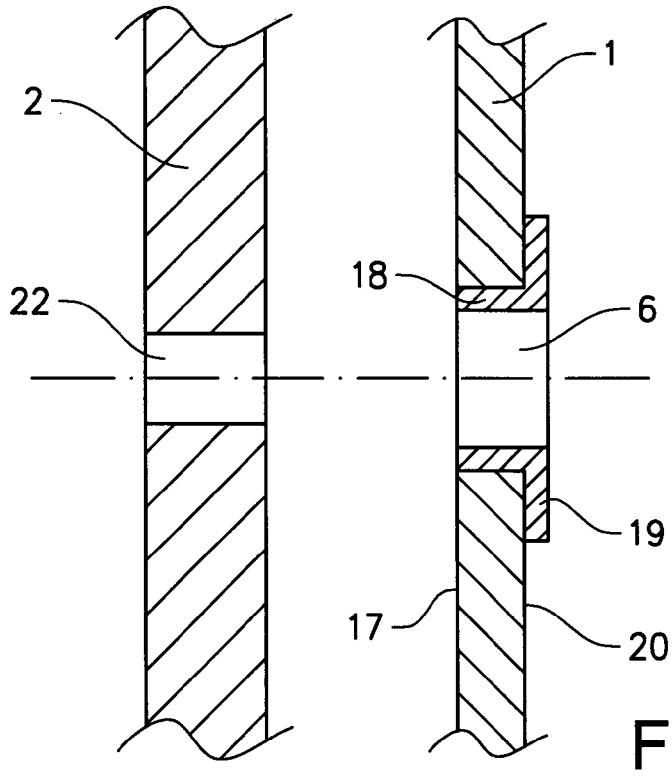
FIG. 4 shows the inventive arrangement after mounting of a sleeve.

FIG. 4 illustrates the inventive method after the step of arranging the flange sleeve 6 in the first hole 5 of the first member 1, such that the flange 19 abuts a front surface 20 of the first member 1. The flange sleeve 6 is secured within the first hole 5 for example by means of welding the flange 19 to the first member 1, wherein particularly spot welding is an efficient and simply fastening means. However, the flange sleeve 6 may alternatively be attached by means of riveting the sleeve 18 on the rear surface 17 of the first member 1 facing the second member 2, or by means of press-fitting the sleeve 18 within the first hole 5, or by other means such as adhesive material.

Important for all methods of attachment are that an adequate electrical connection is provided between the flange sleeve 6 and the first member 1.

Figure 5:
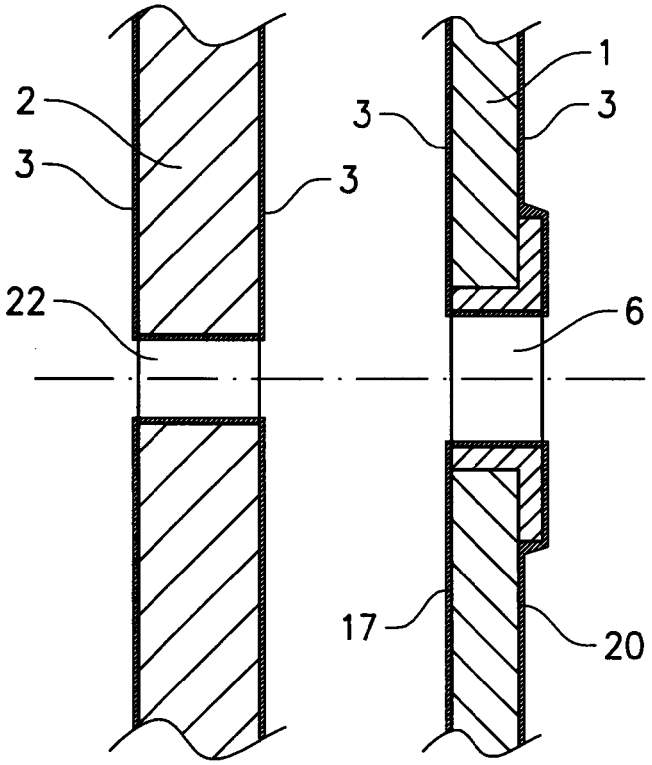
FIG. 5 shows the inventive arrangement after application of a coating layer.

FIG. 5 illustrates the inventive method after additionally having applied a coating layer 3 to the first member 1 including the flange sleeve 6, and to the second member 2. The coating layer 3 of the first and second members 1, 2 covers most of the surfaces of the first and second members 1, 2, including at least partly the inner surface of the second hole 22, as well as the inner the surface of the flange sleeve 6. The coating layer 3 is preferably formed by a powder coating, such as paint.

Figure 6:
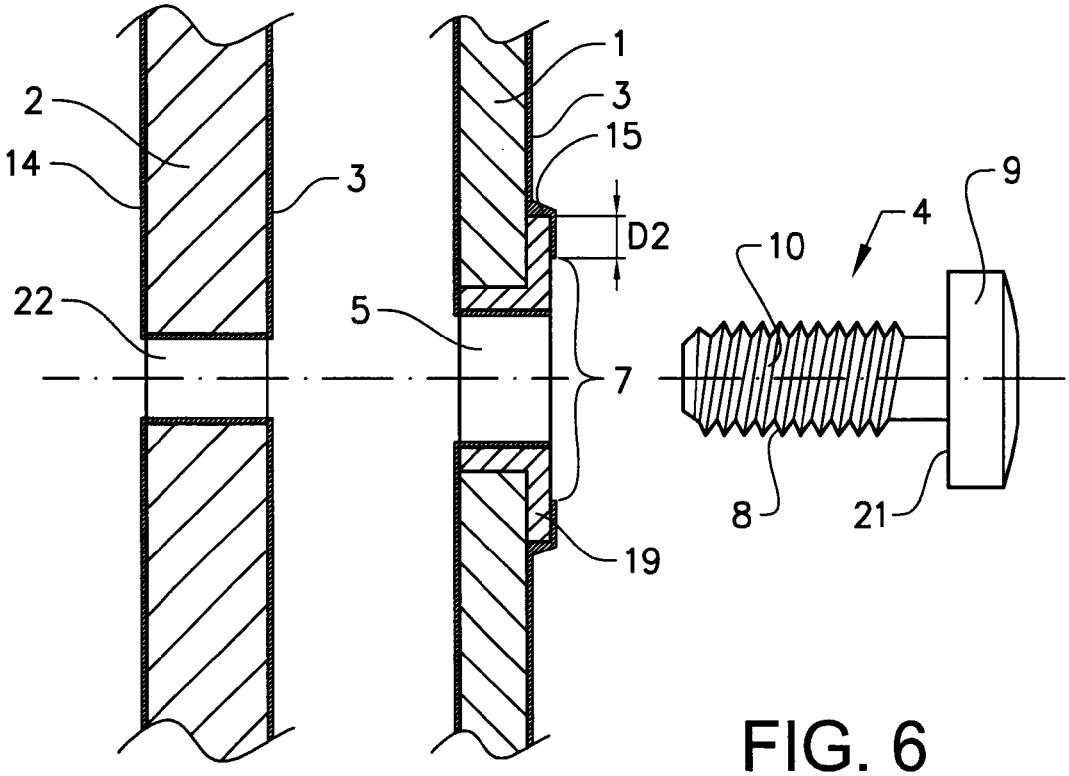
FIG. 6 shows the inventive arrangement with an uncoated surface portion.
Figure 7:
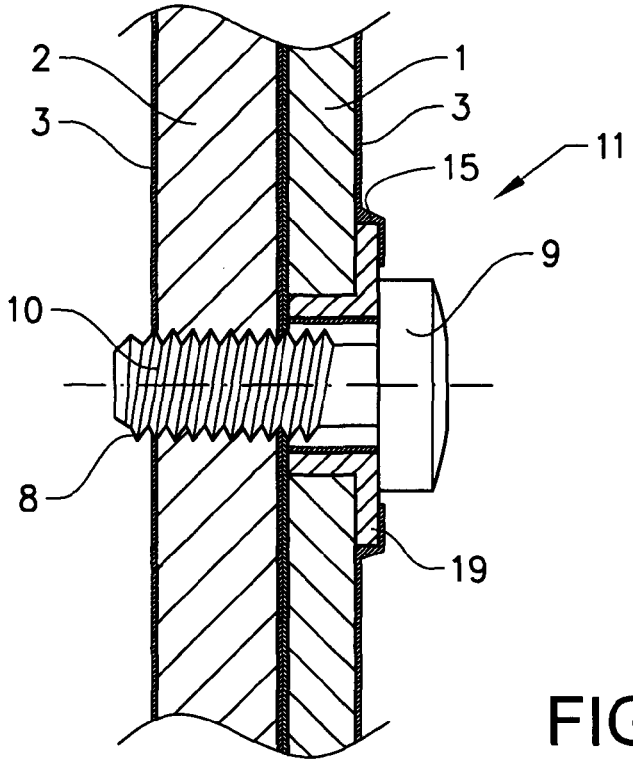
FIG. 7 shows the inventive arrangement in a mounted state.

FIG. 6 and FIG. 7 illustrates the electrical connection arrangement 11 before and after mounting of a fastening element 4 that is used for joining the first and second members 1, 2, both in terms of a reliable and stable mechanical joining and in terms of electrically connecting said members. A head 9 of the fastening element 4 is adapted to abut against the flange 19 for good electrical contact there between, whereby the head 9 may be integral with, or a separate pan of the fastening element 4. An uncoated, preferably circular surface portion 7 is provided on the flange 19 prior to assembly of the fastening element 4 to assure good electrical contact between the flange 19 and an abutment surface 21 of the fastening element 4. The uncoated surface portion 7 is preferably provided by initially coating the entire surface of the flange 19, and subsequently removing the applied coating on a specific area corresponding to the uncoated surface portion 7. The size, form and location of the uncoated surface portion 7 is selected mainly in accordance with form of the head 9 of the fastening element 4, such that an abutment surface 21 of the head 9 will only abut uncoated surface areas of the flange 19 for the purpose of assuring good electrical contact. The uncoated surface portion 7 thus exhibits a larger or substantially identical surface area as the abutment surface 21 of the head 9.

The removal of the coating layer 3 corresponding to the uncoated surface portion 7 is preferably conducted by means of mechanical removal of the coating layer 3, and more preferably by a milling operation, wherein the applied coating layer 3 is removed by a rotating milling cutter. This method is simple, fast and the worked area can be well-defined. Many other methods for removing the coating layer 3 are however applicable, such as for example thermal or chemical removal.

Alternatively, the abutment surface 21 of the fastening element 4 may be provided with, preferably integral tooth-shaped projections that are arranged to scrape and remove the coating layer 3 applied to the corresponding abutment surface of the flange sleeve 6 during assembly of the fastening element 4, such that said uncoated surface portion 7 is provided. This is preferably realised by rotating the fastening element 4 such that said tooth-shaped projections engage the coating layer 3 positioned directly below the head 9, for example simultaneous to mounting and threading engagement of the fastening element 4 in the second hole 22.

The flange sleeve 6 and/or said fastening element 4 are preferably made of a corrosion resistant material, in particular stainless steel, or they are provided with a corrosion resistant coating because they will likely remain uncoated after complete assembly of the electrical connection arrangement 11. The first member 1 is preferably made of coated sheet steel to provide a cost effective and attractive design.

Preferably, in addition to providing a adequate uncoated surface portion 7, the size of the flange 19 and the head 9 are selected such that the coating layer 3 will remain on an outer rim 15 of the flange 19, and even extend a certain distance D2 towards the centre of the flange 19, thus covering a circumferential edge portion of the flange 19. This arrangement serves the purpose of reliably covering and sealing the entire surface of the first member 1 from moisture and humidity that otherwise could lead to corrosion thereof. By extending the coating layer 3 onto the flange 19, a more secure sealing is provided. Furthermore, in case the flange 19 is secured by means of welding, the welding area may be susceptible to corrosion. Hence, by covering also a welding area by the coating layer 3, increased corrosion protection is provided. The distance D2 is selected in accordance with specific implementation, and may for example be selected to range between 0.5-7 mm, preferably 1-4 mm.

Next step according to the inventive method is to insert the fastening element 4 into the flange sleeve 6 and through the first member 1, such that the head 9 of the fastening element 4 abuts only the uncoated surface portion 7 of the flange 19, and to engage the fastening element 4 with the second member 2, such that the fastening element 4 electrically connects the flange sleeve 6 with the second member 2. Engagement of the fastening element 4 that provides an electrical connection with the second member 2 is preferably realised by providing the fastening element 4 with a threaded shank 10 comprising self-tapping threads 8 that form threads in the second hole 22, and consequently simultaneously cut through the coating layer 3 located inside the second hole 22. The fastening element 4 may alternatively be realised as a thread rolling screw, wherein the threaded shank 10 is provided with lobes, preferably forming a trilobal cross-section, wherein the lobes form threads in the pre-formed second hole 22 by pushing the material outward during engagement. Hence, the self-tapping or self-rolling threads 8 of the fastening element 4 reliably and efficiently penetrates the coating layer 3 to provide good electrical contact between the fastening element 4 and the second member 2, and without requiring any after-treatment for improving corrosion protection of the second member 2.

Alternatively, forming threads in the second hole 22 of the coated second member 2 may be performed as a separate assembly step prior to insertion of the fastening element 4, or the threads may be formed in the second hole 22 prior to coating thereof, which threads subsequently being temporarily covered by means of a first cover during coating of the second member 2. A second hole 22 with uncoated threads will then be provided in the second member 2 after removal of the first cover. A threaded member, such as a screw, is hereby advantageously used as first cover. Yet a further alternative solution is to provide the second hole 22 with a larger diameter than the diameter of the threaded shank 10, and instead threadingly engaging the fastening element 4 with a nut arranged on a rear side 14 of the second member 2, whereby an uncoated surface portion on the rear side 14 surrounding the second hole 22 must be provided for providing electrical contact between the fastening element 4, nut, and second member 2. In case the second member is made of a non-corrosion resistant material, after treatment, such as supplementary coating, may be required to assure adequate corrosion protection, or a corrosion-averse flange sleeve may advantageously be provided also in the second member 2. Further alternative means for electrically coupling the fastening element 4 to the second member 2 is to permanently attach the fastening element 4 to the second member 2, for example by means of welding, soldering, or riveting, wherein same of these methods do not require a second hole 22 in the second member 2.

Figure 8:
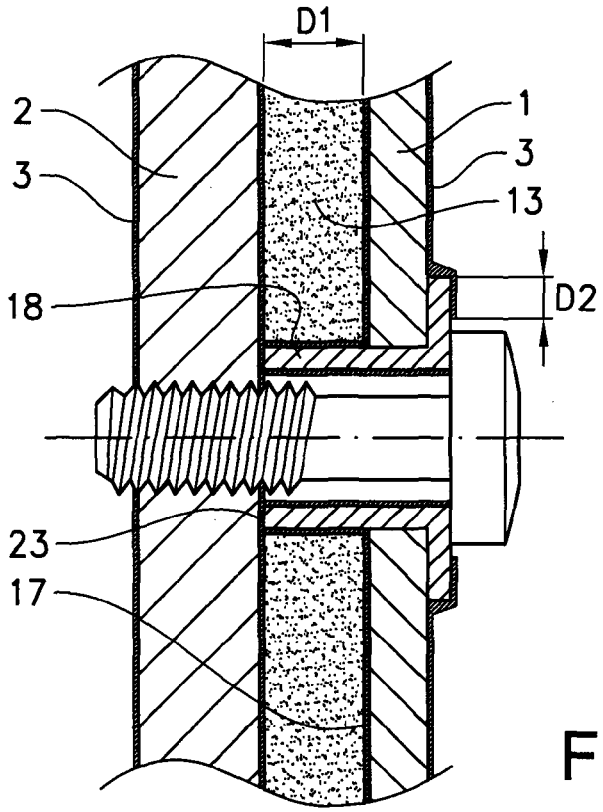
FIG. 8 shows the inventive arrangement including an adhesive material.

Adhesive material 13 may be introduced between the first and second members 1, 2 for improved mechanical joining thereof, and for the purpose of improved sealing of the area of the electrical connection arrangement 11, as illustrated in FIG. 8. The sealing effect is improved by applying the adhesive material 13 at least circumferentially around the first and second holes 5, 22 of the first and/or second member 1, 2 prior to assembly thereof. The sleeve 18 may, in particular in combination with application of adhesive material 13, be arranged to protrude a certain distance D1 beyond the rear surface 17 of the first member 1, such that the second member 2 will abut an end surface 23 of the sleeve 18. The sleeve 18 will then form a spacing element between said first and second members 1, 2, such that over-compression of said adhesive material 13 during joining of said first and second members is prevented. A protruding sleeve 18 may of course be used also without adhesive material 13 arranged between the first and second members 1, 2 in case a certain distance D1 is desired, for example for the purpose of noise elimination due to vibration, or the like. The distance D1 of the protruding portion of the flange sleeve is selected in accordance with specific implementation, and may for example be selected to range between 0.5-10 mm, preferably 1-5 mm.

Figure 9:
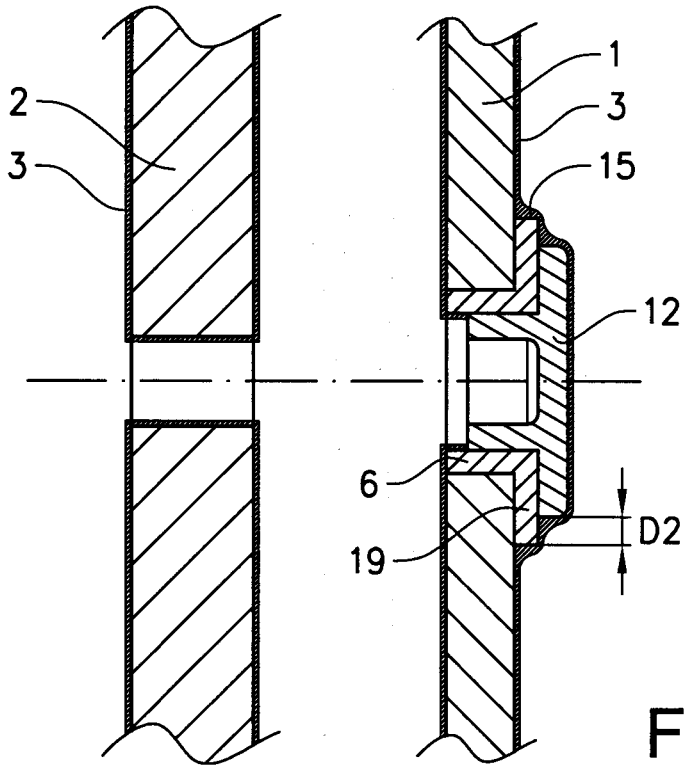
FIG. 9 shows a cover arranged on the sleeve according to the invention.
Figure 10:
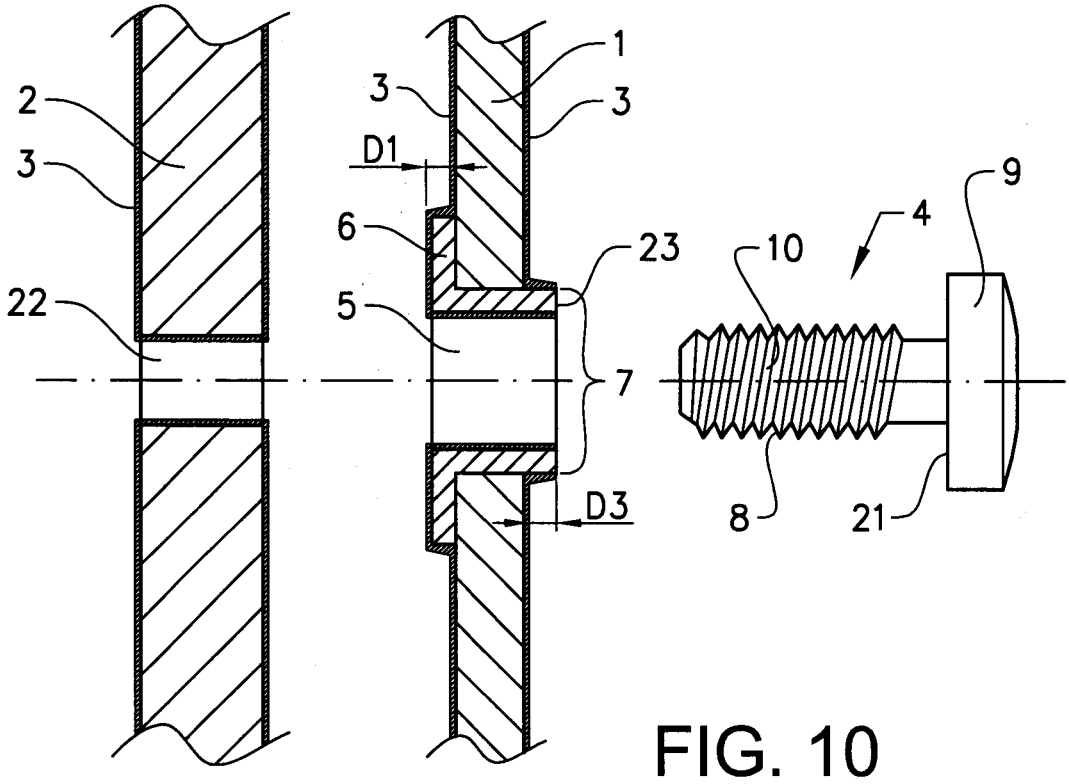
FIG. 10 shows an inventive arrangement where the flange of the sleeve abuts a rear side of the first member.

Many alternative method steps and resulting electrical connection arrangement 11 are included within the scope of the inventive concept. One alternative is shown in FIG. 9, wherein the step of providing an uncoated surface portion 7 on a flange 19 of said flange sleeve 6 is realised by covering a surface portion with a second cover 12 prior to coating of the first member 1, and subsequently removing the second cover 12 after coating to provide a coated first member 1 having the uncoated surface portion 7. Advantageously, the size of the second cover 12 is selected such that the coating layer 3 after application thereof will cover a rim 15 of the flange 19, and extending a certain distance D2 towards the centre of the flange 19, such that moisture is prevented from reaching uncoated areas of the first member 1 to a high degree. A potential weld area is also advantageously covered with the coating layer 3 in case the flange 19 is secured to the first member 1 by means welding.

In FIG. 4, the flange 19 of the flange sleeve abuts a front surface 20 of the first member 1. This configuration provides a relatively large contact surface between the head 9 of the fastening element 4 and the flange sleeve 6, thus assuring good electrical contact. However, in certain situations, such as when the flange 19 is welded to the first member 1, weld spatter from the welding process may bind to the flange 19 and subsequently prevent the head from continuously contacting the uncoated surface portion 7. A solution to this problem is to insert the flange sleeve 6 from the other side of the first member 1, such that the flange 19 abuts a rear surface 17 of the first member 1 instead. The thickness of the head axially will then function as the distance member between the first and second member 1, 2, thus defining a distance D1. Furthermore, the length of the sleeve 18 is preferably selected to protrude a certain distance D3 beyond the front surface 20 of the first member 1 to partly assure that a good electrical contact is provided between the flange sleeve 6 and the fastening element 4, which is arranged to abut an end surface 23 of the flange sleeve located opposite to the head 9, an partly to improve the corrosion protection of the first member, because the coating layer 3 may then advantageously continue onto the outer surface of the sleeve 18, towards the end surface 23, to completely seal the first member 1. The uncoated surface portion 7 would in this arrangement of the flange sleeve 6 be defined by the entire end surface 23.

The invention is not limited to the specific order of the steps disclosed in the text and figures, but includes all variations within the scope of the inventive concept. For example, the fastening element may be attached to the second member prior to coating thereof in case the fastening element does not comprise an integral head, and the fastening element may engage the second member prior to abutting the flange sleeve.

The invention is also not limited to a coated second member having a second hole, as disclosed above in the first embodiment, but the invention in only limited by the scope of the appended claims. Moreover, the invention is not limited to providing an earth connection in working machines, but is equally applicable to all areas where an electrical earth connection between a first and second member is desired.

The drawings are only schematic simplified illustrations of the reality and should not be considered drawn to scale. The thickness of the coating layer is for example often magnified for illustration purposes.

The term electrical connection arrangement is considered to define a connection arrangement that provides low electrical resistance, and thus serve as electrical connection between different members of a common ground plane of for example a vehicle.

The term coated defines a state where a surface has been provided with a coating, which at least partly covers the surface, and the term uncoated defines a surface that either has not been coated, or where the applied coating has been removed.

The term electrically connected is considered defining a connection having a low electrical resistance, suitable for connecting different parts of a common earth structure.

Reference signs mentioned in the claims should not be seen as limiting the extent of the matter protected by the claims, and their sole function is to make claims easier to understand. As will be realised, the invention is capable of modification in various obvious respects, all without departing from the scope of the appended claims.

REFERENCE SIGNS TABLE

1 First member
2 Second member
3 Coating layer
4 Fastening element
5 First hole
6 Flange sleeve
7 Uncoated surface portion
8 Threads
9 Head
10 Threaded shank
11 Electrical connection arrangement
12 Second cover
13 Adhesive material
14 Rear side of second member
15 Rim
16 Electronic equipment
17 Rear surface of first member
18 Sleeve
19 Flange
20 Front surface of first member
21 Abutment surface
22 Second hole
23 End surface

The invention claimed is:

1. Electrical connection arrangement comprising a first member, a second member, and a fastening element, the first member being made of electrically conductive material provided with a coating layer and a first hole, wherein a sleeve is arranged in the first hole prior to application of the coating layer, such that the first member is electrically connected to the sleeve, a head of the fastening element is arranged to abut an uncoated surface portion of the sleeve to provide electrical contact between the sleeve and the fastening element, and the fastening element is engaged with the second member, such that the fastening element is electrically connected to the second member, thereby providing an electrical connection between the first member and the second member.

2. A vehicle, in particular a working vehicle comprising a second member in form of a frame structure forming part of a chassis common ground, and a first member in form of a support member having electronic equipment attached and electrically grounded thereto, wherein the first member is connected to the second member by means of at least one electrical connection arrangement according to claim 1, preferably at least two separate electrical connection arrangements according to claim 1, and more preferably at east three separate electrical connection arrangements according to claim 1.

3. The electrical connection arrangement as set forth in claim 1, wherein the sleeve comprises a flange, and the head of the fastening element abuts the uncoated surface portion of the sleeve on the flange.

4. The electrical connection arrangement as set forth in claim 1, wherein the coating layer is on the first member.

5. The electrical connection arrangement as set forth in claim 1, wherein the fastening element includes a threaded shank that is threadingly engaged with the second member.

6. The electrical connection arrangement as set forth in claim 1, wherein the second member has a second hole, and threads on the threaded shank are configured to form threads within the second hole.

7. The electrical connection arrangement as set forth in claim 1, wherein adhesive material is provided between the first and second members for improved joining and sealing of the first and second members.

8. The electrical connection arrangement as set forth in claim 1, wherein the fastening element is uncoated.

* * * * *